US005284271A

United States Patent [19]

Ross

[11] Patent Number: 5,284,271

[45] Date of Patent: Feb. 8, 1994

[54] SAFETY MUG FOR LIQUIDS WITH IMPROVED LID WHICH PERMITS THE LIQUID TO RETAIN ITS TEMPERATURE AND IMPROVED EXTERIOR BODY CONTOUR TO FACILITATE DESIGNS SILKSCREENED ON THE MUG

[76] Inventor: Gary Ross, 140 Oxnard Ave., Oxnard, Calif. 93035

[21] Appl. No.: 962,965

[22] Filed: Oct. 19, 1992

[51] Int. Cl.[5] ..... A47G 19/22; B65D 41/06

[52] U.S. Cl. ..... 220/711; 220/703; 220/713; 220/719; 220/293; 222/570

[58] Field of Search ..... 220/703, 713, 711, 719, 220/502, 525, 293, 348; 222/563, 569, 570; D7/509, 510, 533, 534, 535, 563; 29/451

[56] References Cited

U.S. PATENT DOCUMENTS

| | | | |
|---|---|---|---|
| D. 106,539 | 10/1937 | Lazar | D7/535 |
| D. 246,882 | 1/1978 | Thrush | D7/536 |
| D. 330,484 | 10/1992 | Ross | D7/536 |
| 2,143,027 | 1/1939 | Perry | 220/703 X |
| 2,529,114 | 11/1950 | Tellier | 220/713 |
| 2,601,767 | 7/1952 | Wall | 220/713 X |
| 2,858,041 | 10/1958 | Robinson | 220/719 |
| 3,360,161 | 12/1967 | Smith | 220/719 |
| 3,784,047 | 1/1974 | Cooper | 220/301 |
| 3,915,355 | 10/1975 | Young | 220/711 X |
| 4,184,603 | 1/1980 | Hamilton, Sr. | 220/254 |
| 4,582,218 | 4/1986 | Ross . | |
| 4,938,375 | 7/1990 | Fantacone | 220/713 X |
| 5,018,636 | 5/1991 | Ross . | |
| 5,102,000 | 4/1992 | Feltman, III | 220/297 |
| 5,147,066 | 9/1992 | Snider | 220/717 |

FOREIGN PATENT DOCUMENTS

| | | | |
|---|---|---|---|
| 1029516 | 6/1953 | France | 220/711 |

*Primary Examiner*—Allan N. Shoap
*Assistant Examiner*—Vanessa Caretto
*Attorney, Agent, or Firm*—Thomas I. Rozsa; Dong Chen

[57] ABSTRACT

The present invention relates to a container for liquid which is able to retain the liquid therein for drinking purposes at a temperature close to its original temperature for a period of time. The design of the top or lid makes it easy to insert, and the new single straight spring arm design utilize a thicker spring arm, will assure vertical tension it needs keep the liquid from spilling out, and it eliminates the need for a gasket to seal the top or lid. The improved exterior shape will make silkscreen process easier.

30 Claims, 2 Drawing Sheets

FIG. 1
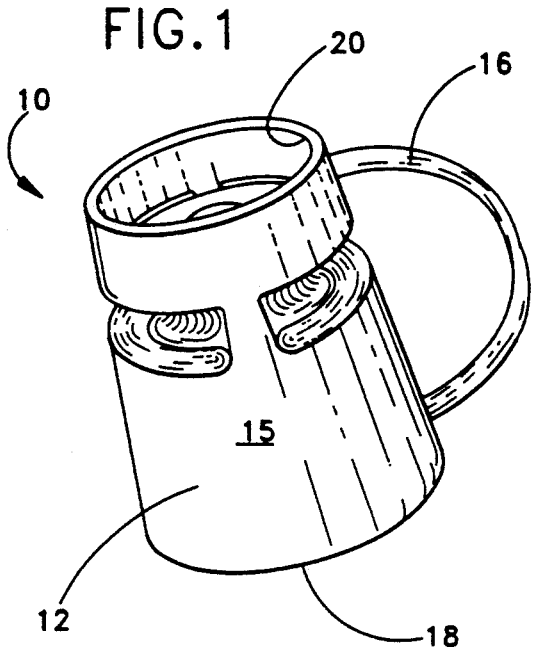
FIG. 3
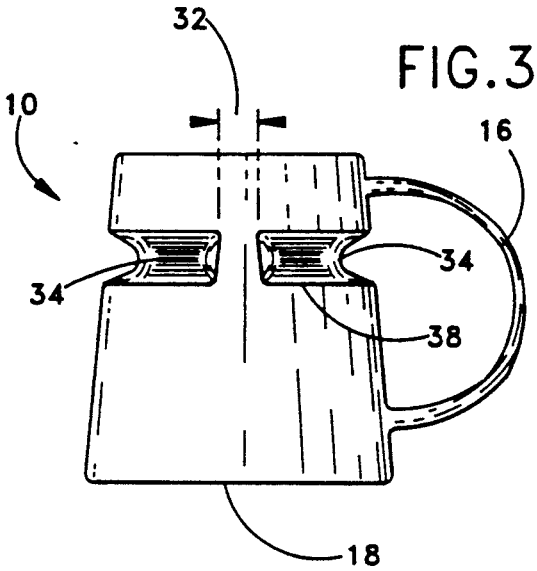
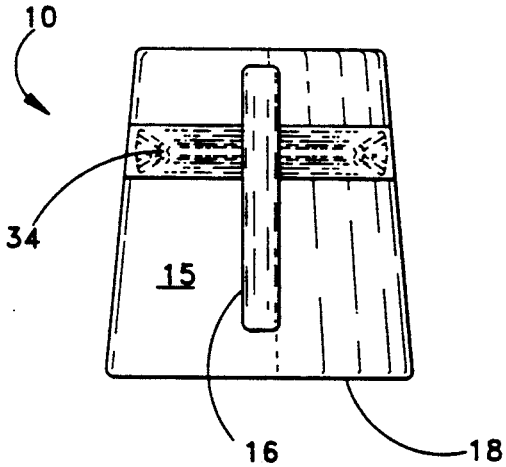
FIG. 4
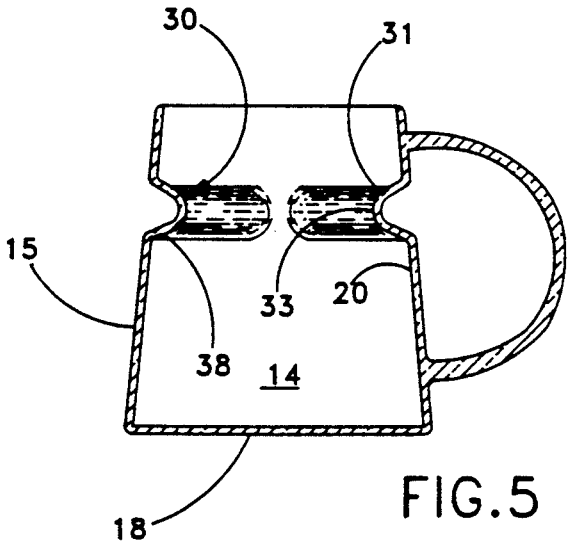
FIG. 5
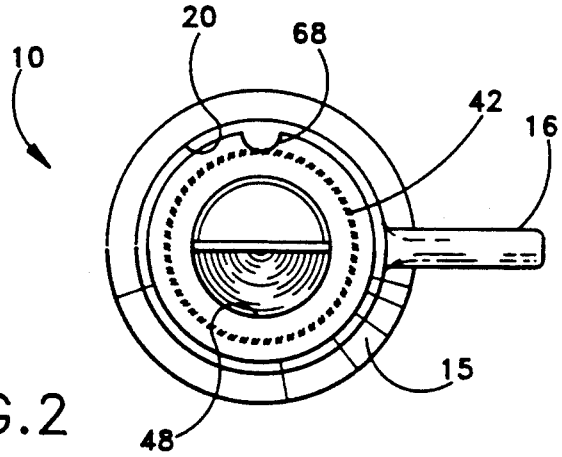
FIG. 2

SAFETY MUG FOR LIQUIDS WITH IMPROVED LID WHICH PERMITS THE LIQUID TO RETAIN ITS TEMPERATURE AND IMPROVED EXTERIOR BODY CONTOUR TO FACILITATE DESIGNS SILKSCREENED ON THE MUG

BACKGROUND OF THE INVENTION

1. Field of The Invention

The present invention relates generally to containers for liquids which permit the liquids to remain hot or cold while it is retained in the container and further permit the user to drink the liquid from the container. The present invention further relates more particularly to removable sealing means on a container which assist in retaining the liquid in the container so that liquid will be restricted somewhat from spilling should the container accidentally be knocked over.

2. Description of The Prior Art

In general, containers which keep a liquid contained therein at almost their original temperature for several hours are known in the prior art. These containers are called vacuum bottles and are comprised of two walls enclosing a vacuum chamber therebetween and fitted with a metal outer case. The vacuum bottle is completely sealed at its opening by means of a screw cap or cork. Liquid is conventionally dispensed from the vacuum bottle into a cup. While it is possible for one to drink directly from a vacuum bottle, it is not commonly done since the opening is not intended to function as a drinking lip and liquid can easily spill out during the drinking process.

Conventional glasses, cups and mugs are commonly used to hold liquids for various purposes. However, their tops are completely open. As a result, the liquid can be retained at its original temperature for only a short period of time. In addition, if the container should accidentally be tipped, the liquid contained therein will spill out.

The inventor, Gary Ross, is also the inventor of inventions disclosed and claimed in U.S. Pat. No. 4,582,218 issued on Apr. 15, 1986 for "Safety Mug For Liquids Which Permits The Liquid To Retain Its Temperature While It Is In The Mug And Further Retain The Liquid If the Mug Is Tipped", and also the U.S. Pat. No. 5,018,636 issued on May 28, 1991 for "Safety Mug For Liquids With Improved Top Which Permits The Liquid To Retain Its Temperature While It Is In The Mug And Further Retain The Liquid If the Mug Is Bumped". The present invention is an improvement in the mug body exterior contour surface to facilitate ease of the silkscreen process to place decals and words on the mug surface and further is an improvement in the top which provides better sealing and more efficient insertion and to eliminate the need for a gasket to seal the top.

SUMMARY OF THE INVENTION

The present invention relates to a container for liquid which is able to retain the liquid therein for drinking purposes at a temperature close to its original temperature for a period of time, will assure that the liquid will be difficult to spill if the container is bumped, and facilitates easy drinking of the liquid from the container.

It has been discovered, according to the present invention, that if the body shape has a straight exterior contour surface instead of a cylindrical shape, this will simplify the silkscreening process. Many prior art mugs are very difficult to silkscreen because their exterior body contours all have certain constricted angles located at where the upper neck portion and lower container portion join.

It has been discovered, according to the present invention, that if the body shape has a straight exterior contour surface, this design shape permits a multiplicity of silkscreen designs which are different from the mug itself to be placed on the mug surface.

The present invention also incorporates a simple but effective design for an internal shelf to permit access so that the sealing member or top can be easily inserted into the container and further provide a design wherein most of the container will remain sealed while a small portion contains an aligned opening between the top and shelf to permit liquid to be drunk from the container. The present invention top incorporates a single straight spring arm that is attached to the bottom of the hemisphere of the top and extends transversely therefrom. The single straight spring arm can be inserted into the mug and positioned beneath an interior wall shelf. The spring tension force created by the angle of the spring arm as it strikes the underside of the shelf of the mug will give it an appropriate tension relative to the top such that the top lies flush against the upper edge of the interior shelf while the single straight spring arm rests just below the shelf and retains the top against the spring arm. Therefore, the top can function as a sealing member to retain the liquid in place and assure that the liquid will not spill if the container is accidentally knocked over. The top will further serve to seal the container to thereby retain the liquid therein at close to its original temperature for a period of time.

It has further been discovered, according to the present invention, that if the sealing member or top contains a gap or opening in its outer perimeter such that it can be aligned with the gap in the shelf, then a user can drink liquid from the container by aligning the gaps so that the liquid can flow out. At the same time, most of the top remains sealed to facilitate retaining the liquid at near its original temperature for a period of time.

It has also been discovered, according to the present invention, that if the shelf is recessed into the container by a sufficient distance such that the top is also recessed into the container, the top is substantially stabilized and will not be easily knocked out of its position. In addition, if the handle portion of the top is recessed into a well in the top, the top can be more easily inserted into the container and rotated about the internal supporting shelf.

It is therefore an object of the present invention to provide a container for liquid which is able to retain the liquid therein for drinking purposes at a temperature close to its original temperature for a period of time, will assure that the liquid will not spill out if the container is knocked over, and facilitates easy drinking of the liquid from the container.

It is an additional object of the present invention to provide the mug design with an insertion of the top, with its improved heat retention and splash reduction and the added benefit of the option of a lower cost and more efficient silkscreening process.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention temperature retaining safety mug.

FIG. 2 is a top plan view of the present invention temperature retaining safety mug.

FIG. 3 is a side elevational view of the present invention temperature retaining safety mug.

FIG. 4 is a rear elevational view of the present invention temperature retaining safety mug.

FIG. 5 is a cross-sectional view of the present invention temperature retaining safety mug.

DESCRIPTION OF THE PREFERRED EMBODIMENT

Figure 6:
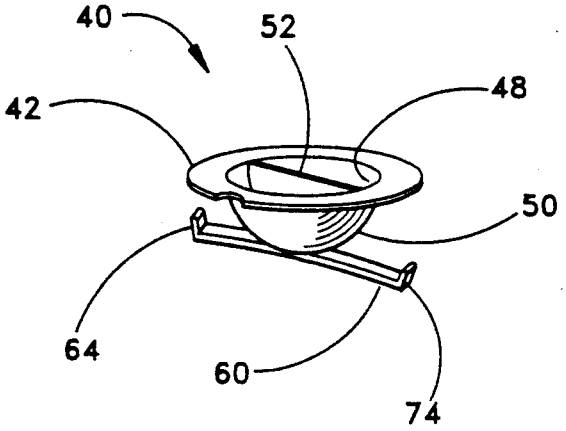
FIG. 6 is a perspective view of the top sealing member or lid.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

A perspective view of the present invention temperature retaining safety mug 10 is shown in FIG. 1. Referring to FIGS. 1 through 5, the body portion 15 of the temperature retaining safety mug 10 comprises a sidewall 12, an internal chamber 14, and a handle 16 attached to the sidewall 12. In the embodiment shown in FIGS. 1 through 5, the sidewall 12 of the temperature retaining safety mug 10 is generally in the shape of a frustum. This design serves to provide greater stability to the temperature retaining safety mug since the base 18 is wider than the upper portion of the temperature retaining safety mug 10. It is emphasized that other designs for the shape of the temperature retaining safety mug such as generally cylindrical are within the spirit and scope of the present invention.

The present invention involves placing a recessed shelf 30 within the temperature retaining safety mug 10. The shelf 30 extends inwardly from the internal wall 20 of the mug 10, and extends for most of the circumference of internal wall 20. By way of example, if the mug is approximately four and one quarter inches tall, the shelf can be recessed such that its top is approximately one-half inch from the top of mug 10. The shelf 30 must contain at least two oppositely disposed gaps 32, one of which is shown in FIG. 3. By example only, the gap 32 can be approximately one-half inch wide. It will be appreciated that the present invention encompasses any multiplicity of such gaps. In the preferred embodiment, the shelf will contain a pair of oppositely disposed gaps located one-hundred and eighty degrees apart. In the preferred embodiment, the body of the temperature retaining safety mug 10 is made of one piece construction with the shelf 30 molded as an integral part of the body. In the preferred embodiment, the sidewall 12 of the temperature retaining safety mug 10 contains a groove or channel 34 at the location of the shelf 30. In order to be properly sealed, the temperature retaining safety mug 10 should be filled to just below the level of the lower surface 38 of the shelf 30.

Figure 7:
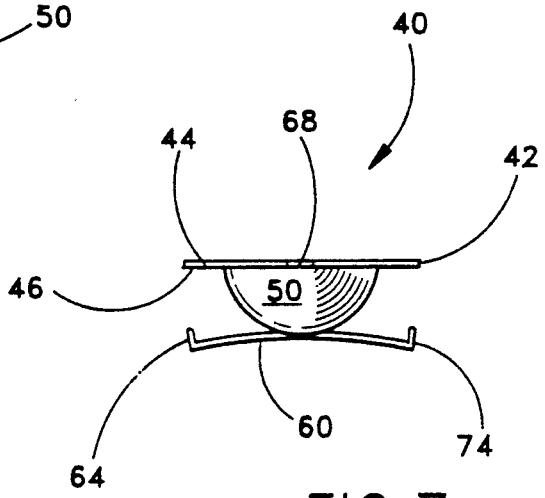
FIG. 7 is a side elevational view of the top sealing member or lid.
Figure 8:
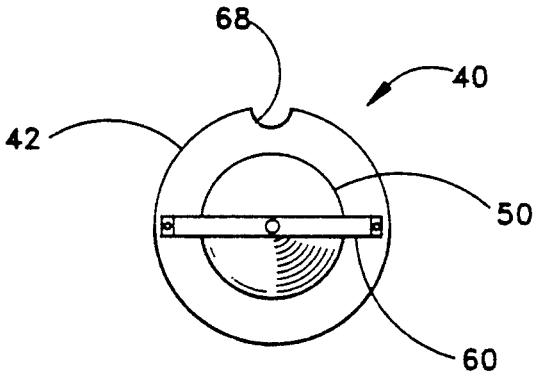
FIG. 8 is a bottom elevational view of the top sealing member or lid.
Figure 9:
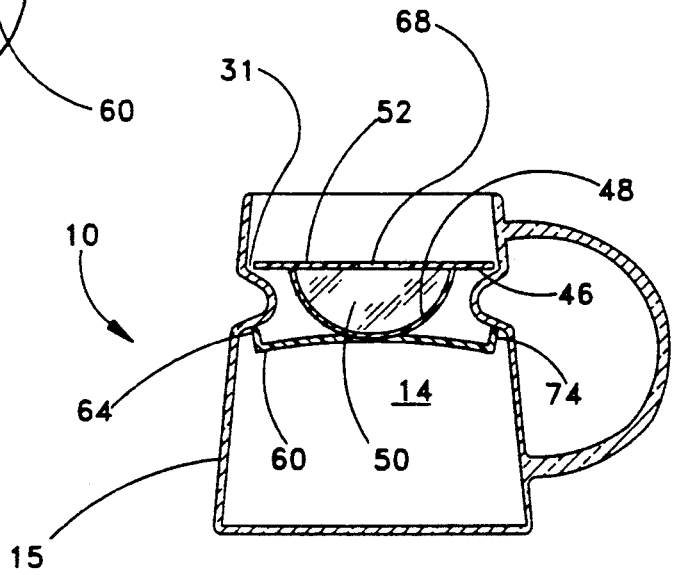
FIG. 9 is cross-sectional view of the present invention temperature retaining safety mug with the lid or top in place with the single straight spring arm resting adjacent to lower edge of the internal shelf.

An important portion of the present invention is the mating sealing member or lid 40 which fits within the temperature retaining safety mug 10 and is rotatably retained by the internal shelf 30. As shown in FIGS. 6, 7, 8, and 9, the sealing member or lid 40 is comprised of a circumferential disk 42 having a top surface 44 and a bottom surface 46. Disk 42 surrounds an interior well 48 which extends into a generally hemispherical body portion 50. Extending into and across the well 48 and terminating at diametrically opposite interior ends of the disk 42 is the handle 52. Therefore, a user can grip the lid by placing his or her fingers into the well 48 and gripping the handle 52 with opposed fingers. The lid 40 is further comprised of a plastic single straight spring arm 60 with tabs 64 and 74 at each respective end of the spring arm. The tabs 64 and 74 are aligned approximately perpendicular to the spring arm 60. The spring arm 60 is attached to the bottom of the hemispherical body portion 50 at a location and further is preferably aligned with handle 52 as shown in FIGS. 6, 7 and 9. In the preferred embodiment, as best illustrated in FIGS. 2, 6 and 8, the lid 40 contains a gap 68. In the preferred orientation, the gap 68 is set at approximately ninety degrees to the single straight spring arm 60.

It is emphasized that while a single straight spring arm disposed retaining means is the preferred embodiment, it is also within the spirit and scope of the present invention to have any multiplicity of such retaining means incorporated into the lid 40. In addition, although the retaining means in the preferred embodiment is a single straight spring arm, the retaining means in other alternative embodiments may include two or more straight flexible branches both attached to and extending symmetrically away from the convex bottom of the lid member.

In operation, the single straight spring arm 60 can be inserted through the two oppositely disposed gaps 32 in the shelf 30 and the lid 40 is rotated by ninety degrees in order to align gap 68 in the lid with a respective gap 32 in the shelf 30 such that the lower surface 46 of disk 42 rests on the upper portion 31 of shelf 30. The single straight spring arm 60 rests adjacent the lower portion 38 of shelf 30 with the tabs 64 and 74 abutting the lower portion 38 of the shelf 30 and serve to retain the lid 40 tightly against the shelf 30 so as to maximize the seal to prevent heat loss and restrict flow of liquid in the event of a knockdown. Liquid is therefore securely retained within the lower portion of chamber 14. When no liquid is to be removed, the lid 40 is placed onto the shelf 30 so that the single straight spring arm 60 and tabs 64 and 74 rest adjacent the lower portion 38 of shelf 30 to hold the disk 42 of lid 40 against the upper portion 31 of shelf 30, with the gap 68 in the lid being flush against top 31 and shelf 30 and away from gaps 32.

No gasket is needed because of the new single straight spring arm 60. As a result, the lower chamber serves to retain the liquid at near its original temperature for at least twenty minutes, with the gap 68 in the lid being flush against top 31 of shelf 30 and away from gaps 32. This is extremely useful when the liquid is hot coffee or a cold soda. When the user wishes to drink the liquid, the top 40 is rotated such that gap 68 is aligned with a gap 32 and the user merely drinks the liquid through the gap 68 on disk 42. Since this is only a small opening, the temperature of the liquid within is still maintained at close to its original temperature.

In most prior art mugs including the mugs previously created in the inventor's prior patents, the lower portion of the mug included a generally frustum shaped design as is present in the current invention but the upper portion of the mug was generally vertical. As a result there was an angle between the upper portion of the mug sidewall and the lower portion of the mug sidewall which made it extremely difficult to silkscreen or otherwise place decorations onto the lower portion of the mug sidewall.

Another unique feature of the present invention is the body portion 15 of the temperature retaining safety mug 10, which comprises a perfectly straight sidewall 12 wherein the upper portion and the lower portion form a completely straight line as best illustrated in FIGS. 3 and 4. By having this perfectly straight line from the upper portion of the mug which rests above the gap 34 and the lower portion of the mug which rests below the gap 34, the mug can be aligned against conventional printing and silkscreening machines so that words, symbols and other decorations can be easily silkscreened on the sidewall 12. By having this straight flat sidewall 12, the silkscreening process is simplified and the cost to decorate the mug is substantially reduced from using a decal process. Therefore, the mug is less expensive to produce and consistent in shape.

Defined in detail, the present invention is a mug comprising: (a) a body member having a circumferential sidewall and a base, where the sidewall has an interior surface and an exterior surface, and the base has a top surface and a flat bottom surface; (b) said exterior surface of said sidewall being configured to have a recessed annular groove which divides said exterior surface of said sidewall into an upper neck portion and a lower container portion; (c) said upper neck portion and said lower container portion of said exterior surface of said sidewall having a common inclined angle and aligned with a same frustum shaped surface; (d) said interior surface of said sidewall and said top surface of said base forming an internal chamber with a top opening; (e) said interior surface of said sidewall being configured to have a protruding annular shelf with an upper portion, a lower portion and two opposite gaps, where the shelf is located adjacent to and spaced from said top opening of said body member; (f) a lid member having a central hemisphere and a circumferential disk with a gap, where the hemisphere has a top concave surface forming a depression and a bottom convex surface, and the disk has a top surface and bottom surface; (g) said lid member also having a lift means mounted across said depression formed by said upper concave surface of said hemisphere; (h) said lid member further having a retaining means, where the retaining means is a single straight flexible spring arm having a center mounted to said bottom convex surface of said lid member and two opposite ends extending away from said bottom convex surface of said lid member and located below said bottom surface of said disk; and (i) a handle member integrally attached to said body member; (j) whereby said uniformly inclined exterior surface of said sidewall of said body member facilitates quick and easy manufacture and ornamentation of said mug, and said lid member can be retained in said body member by inserting said lid member into said body member from said top opening, where said two opposite ends of said spring arm are inserted respectively through said two opposite gaps of said annular shelf until said bottom surface of said disk rests onto said upper portion of said shelf, and rotating said lid member such that said two opposite ends of said spring arm are pressed against said lower portion of said shelf by the retention force of said spring arm, to thereby seal said internal chamber of said body member.

Defined broadly, the present invention is a mug comprising: (a) a body member having a circumferential sidewall and a base, where the sidewall has an interior surface and the base has a top surface and a flat bottom surface; (b) said interior surface of said sidewall and said top surface of said base forming an internal chamber with a top opening; (c) said interior surface of said sidewall being configured to have a protruding annular shelf with an upper portion, a lower portion and at least two opposite gaps, where the shelf divides said sidewall into an upper neck portion and a lower container portion; (d) said upper neck portion and said lower container portion of said exterior surface of said sidewall having a common inclined angle and aligned with a same frustum shaped surface; (e) a lid member having a central hemisphere and a circumferential disk with at least one gap, where the hemisphere has a top concave surface forming a depression and a bottom convex surface, and the disk has a top surface and bottom surface; and (f) said lid member further having at least one retaining means, where the at least one retaining means is mounted to said bottom convex surface of said lid member and has two straight flexible branches extending oppositely away from said bottom convex surface of said lid member; (h) whereby said uniformly inclined exterior surface of said sidewall of said body member facilitates quick and easy manufacture and ornamentation of said mug, said lid member can be retained in said body member by inserting said lid member into said body member from said top opening, where said two opposite flexible branches of said at least one retaining means are inserted respectively through said at least two opposite gaps of said annular shelf until said bottom surface of said disk rests onto said upper portion of said shelf, and rotating said lid member such that said two opposite flexible branches of said at least one retaining means are pressed against said lower portion of said shelf by the retention force of said two opposite flexible branches of said at least one retaining means, to thereby seal said internal chamber of said body member.

Defined more broadly, the present invention is a mug comprising: (a) a body member having a circumferential sidewall and a base, where the sidewall has an interior surface and the base has a top surface and a flat bottom surface; (b) said interior surface of said sidewall and said top surface of said base forming an internal chamber with a top opening; (c) said interior surface of said sidewall being configured to have a protruding annular shelf which divides said sidewall into an upper neck portion and a lower container portion; and (d) said upper neck portion and said lower container portion of said exterior surface of said sidewall having a common inclined angle and aligned with a same frustum shaped surface; (e) whereby said uniformly inclined exterior surface of said sidewall of said body member facilitates quick and easy manufacture and ornamentation of said mug.

Defined also broadly, the present invention is a mug comprising: (a) a body member having a circumferential sidewall and a base, where the sidewall has an interior surface and the base has a top surface and a flat bottom surface; (b) said interior surface of said sidewall and said top surface of said base forming an internal chamber with a top opening; (c) said interior surface of said sidewall being configured to have a protruding annular shelf with an upper portion, a lower portion and at least two opposite gaps; (d) a lid member having a central hemisphere and a circumferential disk with at least one gap, where the hemisphere has a top concave surface forming a depression and a bottom convex surface, and the disk has a top surface and bottom surface; and (e) said lid member further having at least one retaining means, where the at least one retaining means is mounted to said bottom convex surface of said lid member and has two straight flexible branches extending oppositely away from said bottom convex surface of said lid member; (f) whereby said lid member can be retained in said body member by inserting said lid member into said body member from said top opening, where said two opposite flexible branches of said at least one retaining means are inserted respectively through said at least two opposite gaps of said annular shelf until said bottom surface of said disk rests onto said upper portion of said shelf, and rotating said lid member such that said two opposite flexible branches of said at least one retaining means are pressed against said lower portion of said shelf by the retention force of said two opposite flexible branches of said at least one retaining means, to thereby seal said internal chamber of said body member.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A mug comprising:

a. a body member having a circumferential sidewall and a base, where the sidewall has an interior surface and an exterior surface, and the base has a top surface and a flat bottom surface;

b. said exterior surface of said sidewall being configured to have a recessed annular groove which divides said exterior surface of said sidewall into an upper neck portion and a lower container portion;

c. said upper neck portion and said lower container portion of said exterior surface of said sidewall having a common inclined angle and aligned with a same frustum shaped surface;

d. said interior surface of said sidewall and said top surface of said base forming an internal chamber with a top opening;

e. said interior surface of said sidewall being configured to have a protruding annular shelf with an upper portion, a lower portion and two opposite gaps, where the shelf is located adjacent to and spaced from said top opening of said body member;

f. a lid member having a central hemisphere and a circumferential disk with a gap, where the hemisphere has a top concave surface forming a depression and a bottom convex surface, and the disk has a top surface and bottom surface;

g. said lid member also having a lift means for lifting said lid member mounted across said depression formed by said upper concave surface of said hemisphere;

h. said lid member further having a retaining means, where the retaining means is a single straight flexible spring arm having a center mounted to said bottom convex surface of said lid member and two opposite ends extending away from said bottom convex surface of said lid member and located below said bottom surface of said disk; and i. a handle member integrally attached to said body member;

j. whereby said exterior surface of said sidewall of said body member facilitates quick and easy manufacture and ornamentation of said mug, and said lid member can be retained in said body member by inserting said lid member into said body member from said top opening, where said two opposite ends of said spring arm are inserted respectively through said two opposite gaps of said annular shelf until said bottom surface of said disk rests onto said upper portion of said shelf, and rotating said lid member such that said two opposite ends of said spring arm are pressed against said lower portion of said shelf by a retention force of said spring arm, to thereby seal said internal chamber of said body member.

2. The invention as defined in claim 1 wherein said recessed annular groove at said exterior surface of said sidewall is aligned with said protruding annular shelf at said interior surface of said sidewall.

3. The invention as defined in claim 1 wherein said gap in said disk of said lid member is spaced at approximately ninety degrees to said single straight flexible spring arm of said retaining means.

4. The invention as defined in claim 1 wherein said mug is a container for liquids.

5. A mug comprising:

a. a body member having a circumferential sidewall and a base, where the sidewall has an interior surface and an exterior surface, and the base has a top surface and a flat bottom surface;

b. said interior surface of said sidewall and said top surface of said base forming an internal chamber with a top opening;

c. said interior surface of said sidewall being configured to have a protruding annular shelf with an upper portion, a lower portion and at least two opposite gaps, where the shelf divides said sidewall into an upper neck portion and a lower container portion;

d. said upper neck portion and said lower container portion of said exterior surface of said sidewall having a common inclined angle and aligned with a same frustum shaped surface;

e. a lid member having a central hemisphere and a circumferential disk with at least one gap, where the hemisphere has a top concave surface forming a depression and a bottom convex surface, and the disk has a top surface and bottom surface; and f. said lid member further having at least one retaining means, where the at least one retaining means is mounted to said bottom convex surface of said lid member and has two straight flexible branches extending oppositely away from said bottom convex surface of said lid member;

h. whereby said exterior surface of said sidewall of said body member facilitates quick and easy manufacture and ornamentation of said mug, said lid member can be retained in said body member by inserting said lid member into said body member from said top opening, where said two opposite flexible branches of said at least one retaining means are inserted respectively through said at least two opposite gaps of said annular shelf until said bottom surface of said disk rests onto said upper portion of said shelf, and rotating said lid member such that said two opposite flexible branches of said at least one retaining means are pressed against said lower portion of said shelf by retention forces of said two opposite flexible branches of said at least one retaining means, to thereby seal said internal chamber of said body member.

6. The invention as defined in claim 5 further comprising a handle member attached to said body member.

7. The invention as defined in claim 5 wherein said exterior surface of said sidewall being configured to have a recessed annular groove aligned with said protruding annular shelf on said interior surface of said sidewall.

8. The invention as defined in claim 5 wherein said lid member further comprises a lift means for lifting said lid member mounted across said depression formed by said upper concave surface of said hemisphere.

9. The invention as defined in claim 5 wherein said at least one gap in said disk of said lid member is spaced at approximately ninety degrees to said two oppositely extended straight flexible branches of said retaining means.

10. The invention as defined in claim 5 wherein said mug is a container for liquids.

11. A mug comprising:

a. a unitary body member having a circumferential sidewall and a base, where the sidewall has an interior surface and an exterior surface, and the base has a top surface and a flat bottom surface;

b. said interior surface of said sidewall and said top surface of said base forming an internal chamber with a top opening;

c. said interior surface of said sidewall being configured to have a protruding annular shelf which divides said sidewall into an upper neck portion and a lower container portion;

d. said upper neck portion and said lower container portion of said exterior surface of said sidewall having a common inclined angle and aligned with a same frustum shaped surface; and e. a lid further comprising i. a body member having a central hemisphere and a circumferential disk, the hemisphere having a recessed top surface forming a well and a bottom surface, the body member also having a handle disposed within the well for lifting said lid;

ii. at least one flexible retaining member attached to said bottom surface of said body member and extending laterally to reach underneath said disk;

f. whereby said exterior surface of said sidewall of said body member facilitates quick and easy manufacture and ornamentation of said mug.

12. The invention as defined in claim 11 wherein said mug is a container for liquids.

13. The invention as defined in claim 11 further comprising a handle member attached to said body member.

14. The invention as defined in claim 11 wherein said exterior surface of said sidewall being configured to have a recessed annular groove aligned with said protruding annular shelf on said interior surface of said sidewall.

15. A mug comprising:

a. a body member having a circumferential sidewall and a base, where the sidewall has an interior surface and an exterior surface, and the base has a top surface and a flat bottom surface;

b. said interior surface of said sidewall and said top surface of said base forming an internal chamber with a top opening;

c. said interior surface of said sidewall being configured to have a protruding annular shelf which divides said sidewall into an upper neck portion and a lower container portion;

d. said upper neck portion and said lower container portion of said exterior surface of said sidewall having a common inclined angle and aligned with a same frustum shaped surface; and e. a lid member having:

i. a central hemisphere and a circumferential disk with at least one gap, where the hemisphere has a top concave surface forming a depression and a bottom convex surface, and the disk has a top surface and bottom surface; and ii. at least one retaining means, where the at least one retaining means is mounted to said bottom convex surface of said lid member and has two straight flexible branches extending oppositely away from said bottom convex surface of said lid member;

f. whereby said exterior surface of said sidewall of said body member facilitates quick and easy manufacture and ornamentation of said mug, and said lid member can be retained in said body member by inserting said lid member into said body member from said top opening until said bottom surface of said disk rests on top of said shelf and said two opposite flexible branches of said at least one retaining means are engaged underneath said shelf by retention forces of said two opposite flexible branches of said at least one retaining means, to thereby seal said internal chamber of said body member.

16. The invention as defined in claim 15 wherein said lid member further comprises a lift means for lifting said lid member mounted across said depression formed by said upper concave surface of said hemisphere.

17. The invention as defined in claim 15 wherein said at least one gap in said disk of said lid member is spaced at approximately ninety degrees to said two oppositely extended straight flexible branches of said retaining means.

18. A mug comprising:

a. a body member having a circumferential sidewall and a base, where the sidewall has an interior surface and an exterior surface, the base has a top surface and a flat bottom surface;

b. said interior surface of said sidewall and said top surface of said base forming an internal chamber with a top opening;

c. said interior surface of said sidewall being configured to have a protruding annular shelf with an upper portion, a lower portion and at least two opposite gaps;

d. a lid member having a central hemisphere and a circumferential disk with at least one gap, where the hemisphere has a top concave surface forming a depression and a bottom convex surface, and the disk has a top surface and bottom surface; and e. said lid member further having at least one retaining means, where the at least one retaining means is mounted to said bottom convex surface of said lid member and has two straight flexible branches extending oppositely away from said bottom convex surface of said lid member;

f. whereby said lid member can be retained in said body member by inserting said lid member into said body member from said top opening, where said two opposite flexible branches of said at least one retaining means are inserted respectively through said at least two opposite gaps of said annular shelf until said bottom surface of said disk rests onto said upper portion of said shelf, and rotating said lid member such that said two opposite flexible branches of said at least one retaining means are pressed against said lower portion of said shelf by retention forces of said two opposite flexible branches of said at least one retaining means, to thereby seal said internal chamber of said body member.

19. The invention as defined in claim 18 wherein said mug is a container for liquids.

20. The invention as defined in claim 19 wherein said shelf divides said sidewall into an upper neck portion and a lower container portion, which have a common inclined angle and align with a same frustum shaped surface, to facilitate quick and easy manufacture and ornamentation of said mug.

21. The invention as defined in claim 18 further comprising a handle member attached to said body member.

22. The invention as defined in claim 18 wherein said exterior surface of said sidewall being configured to have a recessed annular groove aligned with said protruding annular shelf on said interior surface of said sidewall.

23. The invention as defined in claim 18 wherein said lid member further comprises a lift means for lifting said lid member mounted across said depression formed by said upper concave surface of said hemisphere.

24. The invention as defined in claim 18 wherein said at least one gap in said disk of said lid member is spaced at approximately ninety degrees to said two oppositely extended straight flexible branches of said retaining means.

25. A container comprising:

a. a mug having a top opening extending into a hollow chamber;

b. said mug further having an internal annular shelf adjacent to said top opening;

c. said shelf having at least one gap;

d. a lid having a central hemisphere and a circumferential disk, the hemisphere having a recessed top surface forming a well and a bottom surface, the lid also having a handle disposed within the well for lifting the lid; and e. said lid further having at least one flexible retaining member attached to said bottom surface of said lid and extending laterally, the at least one flexible retaining member further having at least one end tab extending upwardly and located under said disk;

f. whereby said lid can be retained in said mug by inserting said lid into said mug from said top opening, where said at least one flexible retaining member is inserted through said at least one gap in said circumferential disk until said disk rests on top of said shelf, and rotating said lid so that said at least one end tab of said at least one flexible retaining member is engaged underneath said shelf by a retention force of said at least one flexible retaining member, to thereby seal said hollow chamber of said mug.

26. A lid for a mug, where the mug has a top opening extending into a hollow chamber and an internal annular shelf adjacent to the top opening, and the shelf has two opposite gaps, the lid comprising:

a. a body member having a central hemisphere and a circumferential disk with at least one gap, the hemisphere having a recessed top surface forming a well and a bottom surface, the body member also having a handle disposed within the well for lifting said lid;

b. a flexible retaining member attached to said bottom surface of said body member and having two opposite branches extending laterally, each having an end tab extending upwardly and located under said disk; and c. said at least one gap in said circumferential disk being spaced at approximately ninety degrees to said two opposite branches of said flexible retaining member;

d. whereby said lid can be retained in said mug by inserting said lid into said mug from said top opening, where said two opposite branches of said flexible retaining member are inserted through said two opposite gaps of said annular shelf until said disk rests on top of said shelf, and rotating said lid such that said end tab of each one of said two opposite branches of said flexible retaining member is engaged underneath said shelf by a retention force of said flexible retaining member, to thereby seal said chamber of said mug.

27. A lid for a mug, where the mug has a top opening extending into a hollow chamber and an internal annular shelf adjacent to the top opening, the lid comprising:

a. a body member having a central hemisphere and a circumferential disk, the hemisphere having a recessed top surface forming a well and a bottom surface, the body member also having a handle disposed within the well for lifting said lid; and b. at least one flexible retaining member attached to said bottom surface of said body member and extending laterally to reach underneath said disk;

c. whereby said lid can be retained in said mug by inserting said body member into said mug from said top opening until said disk rests on top of said shelf and said at least one flexible retaining member engages underneath said shelf by a retention force of said at least one flexible retaining member, to thereby seal said chamber of said mug.

28. A method for covering a mug, where the mug has a top opening extending into a hollow chamber and an internal annular shelf adjacent to the top opening, and the shelf has two opposite gaps, the method comprising the steps of:

a. providing a lid which has a central hemisphere and a circumferential disk with at least one gap, where the hemisphere has a recessed top surface forming a well and a bottom surface, and the lid also has a handle disposed within the well for lifting the lid;

b. attaching a flexible retaining member with two opposite branches to said bottom surface of said lid, such that the two opposite branches extend laterally to reach underneath said disk and said at least one gap in said circumferential disk is spaced at approximately ninety degrees to said two opposite branches;

c. inserting said lid into said mug from said top opening by passing said two opposite branches of said flexible retaining member through said two opposite gaps of said annular shelf, until said disk rests on top of said shelf; and d. rotating said lid so that said two opposite branches of said flexible retaining member are engaged underneath said shelf by a retention force of said flexible retaining member, to thereby seal said chamber of said mug.

29. The invention as defined in claim 28 further comprising the step of aligning said at least one gap in said circumferential disk of said lid with either one of said at least two opposite gaps in said internal shelf of said mug, so that a user can drink liquid contained in said mug through said at least one gap in said circumferential disk of said lid without detaching said lid from said mug.

30. The invention as defined in claim 28 further comprising the step of offsetting said at least one gap in said circumferential disk of said lid with said at least two opposite gaps in said internal shelf of said mug, such that said at least two opposite gaps in said internal shelf of said mug are completely sealed by said circumferential disk of said lid to prevent liquid contained in said mug from spilling out.

* * * * *